US007943037B2

(12) United States Patent
Gorbaty et al.

(10) Patent No.: US 7,943,037 B2
(45) **Date of Patent: *May 17, 2011**

(54) HYDROCONVERSION PROCESS FOR PETROLEUM RESIDS USING SELECTIVE MEMBRANE SEPARATION FOLLOWED BY HYDROCONVERSION OVER CARBON SUPPORTED METAL CATALYST

(75) Inventors: Martin L. Gorbaty, Westfield, NJ (US); David T. Ferrughelli, Flemington, NJ (US); Edward W. Corcoran, Easton, PA (US); Stephen M. Cundy, Lebanon, NJ (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 462 days.

This patent is subject to a terminal disclaimer.

(21) Appl. No.: 12/073,844

(22) Filed: Mar. 11, 2008

(65) Prior Publication Data

US 2009/0230022 A1 Sep. 17, 2009

(51) Int. Cl.
*C10G 47/02* (2006.01)
*C07C 7/144* (2006.01)

(52) U.S. Cl. ..... 208/112; 208/113; 208/142; 208/121; 208/123; 208/124; 208/133; 210/650; 210/651; 210/652; 210/653; 210/654; 210/655; 585/818

(58) Field of Classification Search ..... 208/112, 208/113, 121–123, 133, 134, 136, 137, 143–145; 210/650–655; 585/818
See application file for complete search history.

(56) References Cited

U.S. PATENT DOCUMENTS

| | | | | |
|---|---|---|---|---|
| 3,894,936 | A * | 7/1975 | Owen | 208/78 |
| 4,134,825 | A | 1/1979 | Bearden, Jr. et al. | |
| 4,226,742 | A | 10/1980 | Bearden, Jr. et al. | |
| 4,244,839 | A | 1/1981 | Aldridge et al. | |
| 4,548,700 | A | 10/1985 | Bearden, Jr. et al. | |
| 4,591,578 | A | 5/1986 | Foley et al. | |
| 4,626,340 | A * | 12/1986 | Galiasso et al. | 208/112 |
| 4,740,489 | A * | 4/1988 | Bearden et al. | 502/150 |
| 5,039,392 | A | 8/1991 | Bearden, Jr. et al. | |
| 6,264,828 | B1 | 7/2001 | Baker et al. | |

(Continued)

OTHER PUBLICATIONS

Masato Kouzu et al., "Catalytic Hydrocracking of Petroleum Residue over Carbon-Supported Nickel-Molybdenum Sulfides", Energy Fuels, 19 (3), 725-730 (2005) (Abstract).

*Primary Examiner* — Glenn A Caldarola
*Assistant Examiner* — Michelle L Stein
(74) *Attorney, Agent, or Firm* — Glenn T. Barrett; Malcolm D. Keen

(57) ABSTRACT

A heavy residual petroleum feed boiling above 650° F.+ (345° C.+) is subjected to membrane separation to produce a produce a permeate which is low in metals and Microcarbon Residue (MCR) as well as a retentate, containing most of the MCR and metals, the retentate is then subjected to hydroconversion at elevated temperature in the presence of hydrogen at a hydrogen pressure not higher than 500 psig (3500 kPag) using a dispersed metal-on-carbon catalyst to produce a hydroconverted effluent which is fractionated to give naphtha, distillate and gas oil fractions. The permeate from the membrane separation may be used as FCC feed either as such or with moderate hydrotreatment to remove residual heteroatoms. The process has the advantage that the hydroconversion may be carried out in low pressure equipment with a low hydrogen consumption as saturation of aromatics is reduced.

22 Claims, 1 Drawing Sheet

U.S. PATENT DOCUMENTS

Figure 1:
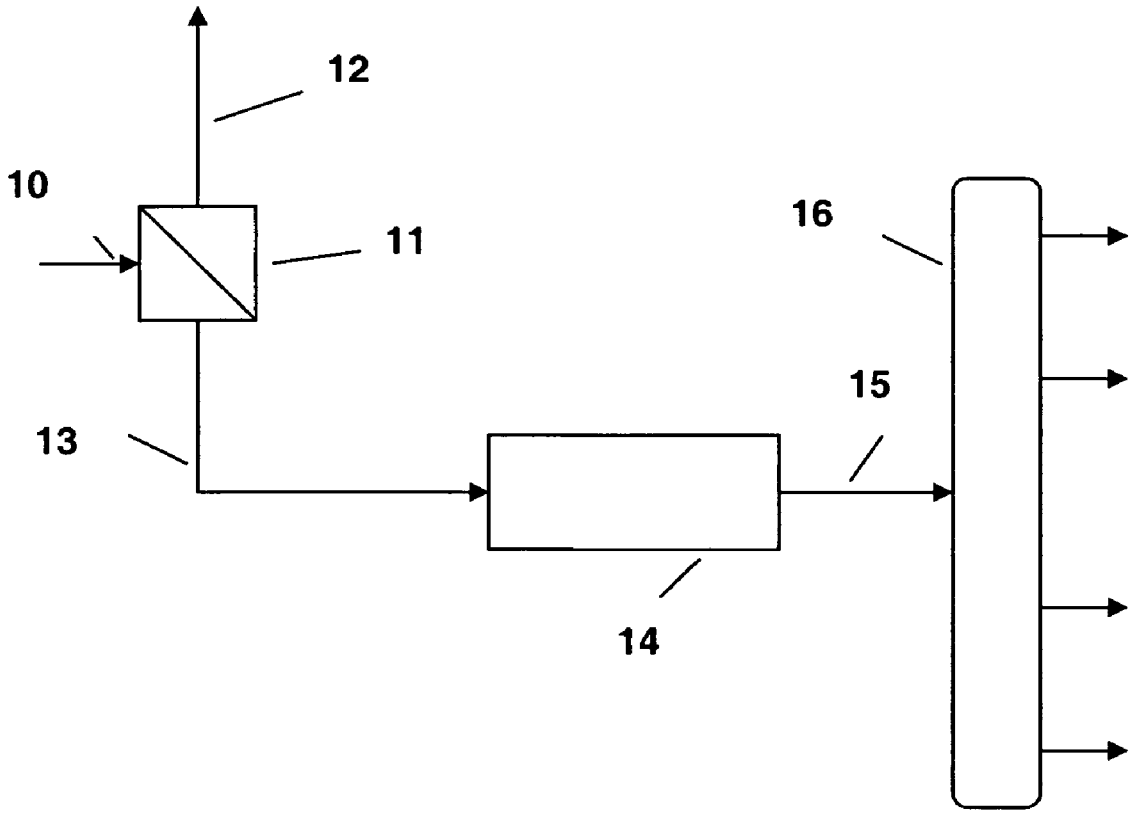

| | | | | |
|---|---|---|---|---|
| 6,896,796 | B2 | 5/2005 | White et al. | |
| 2004/0211706 | A1 | 10/2004 | White et al. | |
| 2005/0005374 | A1 | 1/2005 | Weber et al. | |
| 2009/0057192 | A1 | 3/2009 | Leta et al. | |
| 2009/0057196 | A1 | 3/2009 | Leta et al. | |
| 2009/0057198 | A1 | 3/2009 | Leta et al. | |
| 2009/0057200 | A1 | 3/2009 | Leta et al. | |
| 2009/0057203 | A1 | 3/2009 | Leta et al. | |
| 2009/0057226 | A1* | 3/2009 | Leta et al. | 210/651 |
| 2009/0062590 | A1 | 3/2009 | Nadler et al. | |

* cited by examiner

HYDROCONVERSION PROCESS FOR PETROLEUM RESIDS USING SELECTIVE MEMBRANE SEPARATION FOLLOWED BY HYDROCONVERSION OVER CARBON SUPPORTED METAL CATALYST

FIELD OF THE INVENTION

This invention relates to a process for converting a heavy hydrocarbonaceous feedstock to lower boiling products using a combination of selective membrane separation followed by hydroconversion over a carbon-supported metal catalyst.

BACKGROUND OF THE INVENTION

As the use of low quality refinery feedstocks has increased, a concomitant need for improved resid processing capacity has accompanied it as these feeds generally result in larger quantities of residual fractions in the refinery. At the same time, the long term needs to cut costs and to make cleaner products represent conflicting requirements. Feed accounts for about 70% of the refining costs and the use of less expensive feeds would cut costs. However less expensive feeds typically have higher sulfur, metals, and aromatics which make them more costly to process. Thus, in order to meet the objective of reducing costs, the heavier refinery fractions which contain the bulk of the sulfur, metals and aromatics must be processed more efficiently into the more valuable lower boiling fractions such as gasoline and distillate.

One of the many types of processes developed for the treatment of residual feeds is the hydroconversion of heavy residual feedstocks in a slurry process using a catalyst prepared in a hydrocarbon oil from a thermally decomposable metal compound catalyst precursor. The catalyst may be formed in situ in the hydroconversion zone or separately as described, for example, in U.S. Pat. Nos. 4,134,825; 4,226,742; 4,244,839; 4,740,489 and 5,039,392 which describe processes of this type using catalysts based on the metals of Groups IVB, VB, VIB, VIIB and VIII of the CAS Periodic Table (i.e., Groups 4-10 in the IUPAC Periodic Table (2004)), preferably from Groups VB, VIB and VIII (i.e., Groups 5, 6 and 8 through 10 in the IUPAC Periodic Table (2004)).

In the aforementioned process, it is possible to use hydrogen pressures which are far lower than the 1500-3000 psig (about 10,000-21,000 kPag) used in conventional hydroprocessing techniques. At these lower pressures, typically as low as 250 psig (about 1725 kPag), a substantial proportion, typically up to 65%, of 650° F.$^+$ (345° C.+) resid molecules can be converted to lower boiling range products, e.g. 650° F.$^-$ (345° C.−) fractions, using a few hundred parts per million of a dispersed metal on carbon catalyst at 450° C. (about 840° F.). The small amount of catalyst is enough to maintain coke at a manageable level and the hydrogen pressure is low enough that aromatic rings are not saturated so there is low hydrogen consumption. A significant portion of the feed is converted to lower boiling range products (e.g., products which can be treated as in the 650° F.$^-$ (345° C.−) boiling range) which are high in saturated (aliphatic) molecules. The higher boiling range portion of the reaction products (e.g., the 650° F.$^+$ (345° C.+) portion) can then be treated in separate processing in a way which utilizes the favorable characteristics of the hydroconversion products.

SUMMARY OF THE INVENTION

In the process according to the present invention, the feed for a low hydrogen pressure hydroconversion is provided by subjecting the resid feed to membrane separation with the retentate fraction being used for the hydroconversion step. The permeate, being low in metals and Microcarbon Residue precursors, may be further processed in a fluidized catalytic cracker (FCC) or, optionally, be hydrotreated to remove sulfur and nitrogen before being sent to the FCC. More particularly, according to the present invention, a heavy residual petroleum feed boiling above 650° F.$^+$ (345° C.+) is subjected to membrane separation to produce a permeate which is low in metals and Microcarbon Residue (MCR) precursors as well as a retentate, containing most of the MCR precursors and metals, which is subjected to hydroconversion at elevated temperature in the presence of hydrogen at a hydrogen pressure not higher than 500 psig (3500 kPag) using a dispersed metal-on-carbon catalyst. Advantages of using the low hydrogen pressure hydroconversion are that (1) a significant portion of the retentate can be converted to naphtha and distillate, which are almost identical to virgin naphtha and distillate, without the consumption of large amounts of hydrogen, (2) there is less capital investment cost since the low hydrogen pressure needed for the conversion can be achieved with thin walls of standard metallurgy rather than thick walls of standard or exotic alloys and (3) capital and operating costs for compression of hydrogen at lower pressure are significantly reduced. The membrane separation, in turn, requires lower investment and operating costs relative to distillation of the feed.

DRAWINGS

FIG. 1 of the accompanying drawings shows a simplified process schematic for the present process.

DETAILED DESCRIPTION

According to the present invention, the first step in the conversion process comprises a separation of the starting residuum using a membrane to recover a permeate which is relatively low in metals and Microcarbon Residue (MCR) precursors and high in atomic H/C. This permeate fraction may be further processed in a fluidized catalytic cracker (FCC) with no or slight modification. The membrane-retained liquids (retentate) which, relative to the permeate, are high in metals and MCR precursors is treated in a second step which involves a mild slurry hydrotreating followed by fractionation to recover a liquid product which is relatively clean compared to the initial retentate feed. The bottoms fraction from the hydrotreating may be used as coker feed.

The basic process configuration is shown in FIG. 1. In the first step of the process, the feed, suitably an atmospheric or vacuum residuum or alternatively, a whole or reduced crude, enters through line 10 to be separated by passing it through a membrane separation step 11 which produces a permeate, which has a relatively low level of MCR precursors and metals, and a retentate with a relatively higher level of MCR precursors and metals content. The permeate may be sent directly by way of line 12 to a fluid catalytic cracker (FCC, not shown), or to a mild hydrotreater for feed cleanup if needed before going to the FCC. The membrane-retained liquid (retentate) is sent through line 13 to reactor 14 to be processed in a second step under mild hydroconversion conditions described further below. The hydroconverted effluent then passes by way of line 15 to fractionator 16 in which it is separated in the conventional manner according to boiling point of the components to produce a range of liquid products of which four streams are indicated including naptha, distillate, a gas oil fraction, typically boiling in the 650° F./345° C.

to 1050° F./565° C. range and a high boiling bottoms fraction. The gas oil fraction, like the permeate fraction from the membrane separation step is suitable for use as FCC feed or, alternatively, may be combined directly with other refinery streams or sent to mild hydrotreating before blending. The bottoms fraction boiling above the gas oil fraction (i.e., typically above 1050° F./565° C.) may be sent to a thermal cracking process such as a fluid or delayed coker.

A variety of membrane materials may be considered for the initial membrane separation step, including molecular weight cutoff polymer membrane systems, surface-functionalized polymers, polymer membranes with inherent voids in their structure, polymer membranes containing entrained inorganics, carbon membranes, and numerous inorganic membrane systems. Typical polymer membrane materials which may be used when produced with the requisite porosity include polyimides, polycarbonates, poly(acrylonitrile-co-methacrylic acid) and expanded poly(tetrafluoroethylene). The latter class of inorganic membrane systems contains a multitude of compositions (e.g., alumina, silica, titania, zirconia, and many composites of these oxides, as well as zeolites) ranging from microfiltration capabilities to ultra- or nanofiltration systems. Pervaporation membranes may also find application in this process. Depending upon the feed and the selected membrane, the degree of separation of the low metals/MCR permeate and the high metals/MCR retentate may be determined empirically in accordance with known parameters and correlations for such systems. Permeability of the membrane will also need to be determined on an empirical basis since the molecular dimensions of the feed molecules will vary according to the composition of the feed to the separation step. In general, permeabilities in the order of 50 to 50,000 Gurley seconds are useful for most feeds with values of 1,000 to 10,000 Gurley seconds (e.g., approximately 5,000 Gurley seconds) being the normal order for useful membranes.

The membrane system can be engineered in several different feed configurations, such as 'batch' feed to the system, or crossflow feed, where the feed is recycled over the front side of the membrane. Likewise the membrane can be 'dead-ended' where the permeate collects on the backside of the barrier, or a permeate sweep can be utilized. These configurations, and the process conditions where the system is operated, can dramatically affect membrane performance.

The residual feed is contacted in either batch mode, or in feed recycle configuration with the front side of the separation membrane, at ambient to elevated temperatures (room temperature to 500° C., normally not more than 200° C. and in most cases not more than 100° C.), and moderate to high feed pressures (200 to 21,000 kPag/about 30 to 3000 psig). The use of higher pressures has been found to be favorable to the properties of the permeate in that the microcarbon residue precursors and metals contents (mainly, nickel and vanadium) are lower at high pressures. It is hypothesized that under pressure over a porous membrane material, the polar constituents of a heavy hydrocarbon liquid mixture tend to associate, forming a layer of aggregated polar material (over or at the membrane surface), which, in turn, serve to reject polars and other large molecules, but pass more linear and smaller molecules such as saturates. As the pressure increases, the efficacy of this layer appears to increase further restricting passage of polars with a net increase of efficiency (i.e., rejecting MCR precursors and metals with greater efficiency). When the feed pressure is removed, the layer tends to disassociate, returning to a homogenous mixture of heavy hydrocarbons. While batch operations are simpler, feed recycle can sometimes maintain higher fluxes in operation by reducing membrane fouling at the surface; selectivities can also potentially improve in this configuration by reducing local concentration gradients of the feed at the membrane surface during operation. Membrane performance can sometimes be improved during operation by removal of the membrane for cleaning, or through in situ performance regeneration procedures (e.g., backflushing).

Permeate from the membrane separation may be collected by gravity flow, or can be swept away from the backside of the membrane using a compatible sweep. This latter mode of operation can sometimes improve membrane performance by reducing a buildup of permeate on the backside membrane surface.

The membrane permeate obtained from the initial resid feed stream contains only low levels of MCR precursors and metals and can be sent to the FCC as a blend with conventional VGO or optionally sent to a FCC feed hydrotreater before going to the FCC. The retentate, containing most of the MCR precursors and metals is sent to a dealkylation refining conversion unit.

The Microcarbon Residue (MCR) is determined by test method ASTM D4530, Standard Test Method for Determination of Carbon Residue (Micro Method). Carbon residue may also be measured by ASTM D189-06 Standard Test Method for Conradson Carbon Residue of Petroleum Products (CCR).

The membrane separation may be expected to yield permeates with MCR levels of not more than 5 wt. pct., desirably not more than 3 wt. pct. with values of not more than 2 wt. pct. achieved in favorable cases from resid feeds having CCR values as high as 6 wt. pct. or more, e.g. 8 or 10 pct. The retentate, by contrast, will likely exhibit MCR values of at least 10 or 12 wt. pct., depending on feed and selected conditions. Reductions in MCR of at least 70 wt. pct. between the resid feed and the permeate product are reasonably expected with values of at least 75 wt. pct. or higher having been achieved. Concomitantly, reductions in metals will normally exceed 80 or 90 wt. pct. with lesser proportionate reductions in Total Acid Number (TAN) depending on the chemical composition of the resid feed. TAN is conventionally determined by ASTM Standard Test Method D664 but may also be measured by ASTM D974, D1534 or D3339.

The hydroconversion step which follows for the retentate functions by a dealkylation mechanism in which long chain alkyl groups on the resid feed are hydrogenatively split off aromatic nuclei to form low boiling (typically 650° F.−/345° C.−) liquids which are predominantly saturated, normally containing 75-85% saturated molecules with the remaining 15-25% aromatic molecules being mostly single ring aromatics. The low boiling liquid products produced from this step of the process will, in general, have almost the identical properties (e.g., boiling points, compositions) of virgin naphthas and distillates produced from virgin crudes with the exception that the N and S levels will be slightly higher.

The hydroconversion (dealkylation) step converts 650° F.$^+$ and/or 1050° F.$^+$ retentate feed molecules into 650° F.$^-$ and/or 1050° F.$^-$ boiling range products using a few hundred parts per million of a dispersed metal-on-carbon catalyst. The small amount of catalyst is enough to hold coke-make to a manageable level. The hydrogen pressure is low enough that aromatic rings are not saturated so there is low hydrogen consumption. A significant portion of the retentate feed is converted to 650° F.$^-$ boiling range products, which are high in saturated (aliphatic) molecules, and vacuum gas oil (650-1050° F.).

The hydroconversion step for the retentate is characterized by its use of a dispersed metal-on-carbon catalyst at low hydrogen pressures below 500 psig/3,500 kPag, typically below about 250 psig (1725 kPag). Temperatures used in this step are quite high for hydroconversion, typically from 650° F./345° C. or higher and usually at least 770° F./410° C. with a normal maximum of 890° F./475° C.; in most cases the temperature will be in the range of 800° F./425° C. to 850° F./450° C. It has been found that the use of low hydrogen pressures in this step is important for the preferential production of liquid product; if pressures are increased to the level conventionally used in hydroprocessing, for example, about 7,000 kPag (1,000 psig), the proportion of liquid product from this step of the processing decreases markedly. Conditions for this part of our invention may however be varied over this range depending on the type of residuum feed used as the starting material, and the amount and quality of the liquids desired.

The hydroconversion is carried out in the presence of a dispersed metal-on-carbon catalyst. These catalysts may be made in different ways, including in-situ decomposition of a soluble inorganic or organic compound of the catalytic metal in oil or alternatively, by the addition of a dispersible, preformed metal-on-carbon catalyst to the heavy oil feed. The metals used in these catalysts are the transition metals which possess hydrogenation activity and therefore will be selected from Groups IVB, VB, VIIB, VIIB and VIII of the CAS Periodic Table (i.e., Groups 4-10 of the IUPAC Periodic Table (2004)), preferably from Groups VB, VIB and VIII (i.e., Groups 5, 6 and 8 through 10 in the IUPAC Periodic Table (2004)). Thus, dispersed metal-on-carbon catalysts using titanium, zirconium, vanadium, niobium, tantalum, chromium, molybdenum, tungsten, manganese, rhenium, iron, cobalt, nickel as well as the noble metals platinum, palladium, osmium, ruthenium, and rhodium may be the catalytic metals in such catalysts. Normally, however, the metal will be a base metal selected from vanadium, chromium, molybdenum, tungsten, cobalt or nickel although the noble metals platinum and palladium also possess hydrogenation capability. The preferred metal is molybdenum and accordingly, these catalysts will be referred to for convenience as molybdenum-on-carbon catalysts and their preparation described with reference to molybdenum as the active metal component.

These catalysts may be prepared, in general terms, by converting an oil soluble compound of the catalytic metal while in solution in an oil which contains micro-carbon precursors (typically with an MCR of 3 wt. pct. or more) to form particles of catalytic metal component dispersed on carbon particles; the conversion is effected by treatment with a mixture of hydrogen sulfide and hydrogen, at elevated temperature. Oils which conform to this requirement are generally classified as residual fractions themselves; both atmospheric resids and vacuum resids will be suitable subject to the microcarbon residue content. The metal component on the catalyst is believed to be present in the sulfide form since the use of hydrogen sulfide in the catalyst formation has been found to give good results in terms of catalytic activity; its use however, is not conceived as indispensable since degradation of sulfur compounds in the oil at elevated temperatures, e.g. above about 350° C. (about 660° F.), in the presence of hydrogen and the metal compound may be sufficient to deposit the metal as sulfide on the carbon support. The use of hydrogen sulfide is particularly preferable with oils which contain relatively low levels of sulfur and is generally to be recommended in order to ensure that the metal is present in the sulfide from in the dispersed catalyst. Suitable oil soluble compounds which are convertible to dispersed catalysts include inorganic compounds of the metals, especially heteropoly acids such as phosphomolybdic acid, molybdosilicic acid, salts of the metals with organic acids such as alicyclic and acyclic carboxylic acids containing two or more carbon atoms (e.g., naphthenic acids), salts of aromatic carboxylic acids such as toluic acid, salts of sulfonic acids (e.g., toluene sulfonic acid) and sulfinic acids, mercaptides, xanthates, metal salts of phenols, and polyhydroxyaromtics, as well as organometallic compounds such as metal chelates (e.g., with 1,3-diketones, ethylenediamine, ethylenediamine tetraacetic acid, phthalocycanines and metal derivatives of organic amines such as aliphatic amines, aromatic amines and quaternary ammonium compounds). The metal compound may be dissolved in water which is later removed at the elevated temperature used for the conversion. The reaction of the metal compound in the presence of the microcarbon residue precursors in the oil results in a catalytically active metal sulfide-on-carbon dispersion. This dispersion may be used as such or the dispersed catalyst particles may be separated and used with a different oil feed. Normally, however, since the oil which is to be treated is a resid, that is, an oil which contains microcarbon residue precursors (or you could say "an oil with an MCR of >3 wt %"), it suffices to generate the catalyst in situ in the resid feed, obviating the need for separation.

Suitable exemplary methods for the preparation of these catalysts are found in U.S. Pat. Nos. 4,134,825; 4,226,742; 4,244,839; 4,740,489 and 5,039,392, to which reference is made for a description of such techniques. A preferred technique is to prepare the catalyst as a dispersion in the heavy oil feed which is to be processed in the hydroconversion by decomposing the metal (e.g., molybdenum) compound under heat in the presence of hydrogen, preferably a mixture of hydrogen and hydrogen sulfide. This oil dispersion of the catalyst may then be conveniently added directly to the feedstream in the required amount before the feedstream enters the hydroconversion reactor. Thermal decomposition temperatures of at least 200° C., generally in the range of 200-500° C. are in general useful with temperatures in the range of 300-400° C. preferred. The preferred catalysts are molybdenum-based and contain from 20 to 30 wt. pct. of molybdenum. If other catalytic metals are used, the amount will vary depending on the activity of the metal in the catalyst. The amount of metal on the catalyst will depend in part on the MCR value of the oil in which the catalyst is generated: higher MCR values for the oil will lead to relatively lower metal contents in the final catalyst. For example, generation of a molybdenum-on-carbon catalyst in an oil with an MCR of about 10 percent may be expected to result in a catalyst with 25-30% of the metal as metal sulfide on the carbon but use of an oil with an MCR value of about 20 percent would be expected to result in a catalyst with a relatively lower content of the metal sulfide. In this way, the metal content of the catalyst may be controlled by use of the appropriate oil. The activity of the catalysts is usually enhanced by carrying out the decomposition in the presence of hydrogen sulfide to ensure the production of a sulfided catalyst product.

The amount of catalyst used will depend on the feed type and the hydrogen pressure as well as the acceptable level of the toluene insolubles tolerated by the process but the process using these dispersed metal sulfide catalysts is notable for the very small catalytic amounts that may be employed. The amount of catalyst is typically from about 100-5,000 ppmw relative to the weight of the heavy oil feed and in most cases from 100-2000 ppmw, preferably from 250-1,000 ppmw, relative to feed, and is calculated based on the weight of the metal in the catalyst.

The products of the hydroconversion are distilled to produce products of the desired boiling range such as the naphtha, distillate, a 650-1050° F. cut (VGO) and a 1050° F.$^+$ residue referred to above.

Example 1

Catalyst Preparation

A catalyst was prepared by decomposing a dispersion of phosphomolybdic (PMA) acid in Arabian Light Atmospheric Resid (ALAR) in the presence of $H_2S$ and filtering it from the oil. An autoclave was charged with 100 g of ALAR and the PMA dispersed in the oil was added. The autoclave was heated to 150° C., after which the autoclave was charged to 100 psig (690 kPag) with $H_2S$ while being stirred and held at temperature for 30 min. The autoclave was then flushed with hydrogen and heated to 280° C. under 1000 psig (7,000 kPag) of static hydrogen. Hydrogen flow was started at 0.45 l/min as the autoclave was heated to 390° C. and held at these conditions for one hour. After cooling to 150° C. the reactor was vented and the contents filtered and washed with toluene to remove residual oil.

Example 2

General Conversion Procedure

A 300 cc autoclave was charged with 100-150 g of residuum feed stock and the appropriate amount of catalyst, chosen on the basis of weight of catalyst metal relative to feed, was added. The autoclave was flushed out with hydrogen and heated to 280° C. under static hydrogen pressure. Hydrogen flow of 0.45 l/min was started at this time to ensure that hydrogen starvation did not occur during the run. The hydrogen pressure, final temperature and time (run severity) were chosen to achieve the extent of conversion desired. The mixture was stirred during reaction to ensure adequate mass transfer of hydrogen. Lighter liquids produced (650° F.$^-$/345° C.−) during the run were collected in a chilled knockout vessel downstream of the autoclave. After the specific reaction time at temperature had been achieved, the autoclave was cooled to 270° C. then purged with hydrogen gas for 30 minutes to remove any lighter liquids remaining in the reactor. Gas produced during the run was collected in a gas collection bag situated downstream of the knockout vessel. After the 30 minute purge, the residual oil was cooled to about 200° C. and filtered to remove the catalyst and any toluene insolubles (coke) produced. The oil remaining in the autoclave, (residual oil, 650° F.$^+$/345° C.+), the knockout liquids (650° F.$^-$/345° C.−), and the gas products were analyzed to determine yields and qualities.

Example 3

Liquid Yield Relation to Hydrogen Pressure

The procedures of Examples 1 and 2 were followed to produce the data shown in Table 1 for both ALAR and Arabian Light Vacuum Residuum (ALVR). Hydrogen pressure was varied from 250-1000 psig (1725-7,000 kPag) to illustrate the effect on gas/liquid yields and the amount of toluene insolubles produced. Liquids are the light (650° F.−/345° C.−) liquids collected in the knockout vessel.

TABLE 1

Hydroconversion Liquid Yield.

| Feed | Catalyst, Mo ppm | Temp., ° C. | Severity[a] | H2 Press., psig/kPag | Liquids, Wt % | Gas, Wt. % | Coke, Wt. % |
|---|---|---|---|---|---|---|---|
| ALAR | 250 | 425 | 2X | 250/1725 | 32 | 4.4 | 1.2 |
| ALAR | 250 | 425 | 2X | 1000/7000 | 20 | 6 | 0.5 |
| ALAR | 1000 | 450 | 4X | 250/1725 | 47 | 6 | 2.1 |
| ALAR | 1000 | 450 | 4X | 1000/7000 | 32 | 7.8 | 0.7 |
| ALVR | 250 | 425 | 2X | 250/1725 | 26 | 5 | 4.9 |
| ALVR | 250 | 425 | 2X | 1000/7000 | 14 | 4 | 1.3 |

Note:
One time severity is defined as 120 min. at 411° C. Severities at other temperatures are corrected using a 53 kcal/mole activation energy.

Data from the conversion of both the atmospheric and vacuum residua show that more liquids are produced at the lower hydrogen pressure in all cases. In the atmospheric residua cases (ALAR), coke levels rise when converted at 250 psi but only slightly. The coke increases more rapidly in the vacuum resid case (ALVR) when converted at 250 psi.

Example 4

Membrane Separation of Resid Feed

A topped Chad crude oil, roughly equivalent to an atmospheric residuum (6.19 wt % MCR; 457 ppm Ca; TAN=4.41) was subjected to membrane separation using a batch operation membrane separation mode at 100° C. and 700 psig/700 kPag on an as-received Gore-Tex™ 5000 Gurley-sec, expanded PTFE (ePTFE) membrane. The separation of one hundred grams of crude produced 56 g of permeate and 44 g of retentate. At these conditions, reasonable selectivities for calcium and TAN (i.e. high rejection rates) were observed during several hours of operation. Data from this test are shown in Table 2 below. The table shows that MCR and calcium levels were reduced significantly, and that the retentate is enriched with MCR and calcium. The retentate served as a feed stock for the second step of the process. It contained 10% of 650° F.−/345° C.−, 33% 650-1050° F./345-565° C., and the remainder, 57%, was 1050° F.+/565° C.+

TABLE 2

| Membrane Separation of Chad Feed | | | | | | |
|---|---|---|---|---|---|---|
| | Permeate | | | Reduction, % | | |
| Feed | MCR, wt. % | Ca, ppmw | TAN | MCR | Ca | TAN |
| Permeate Run 1 | 1.18 | 11.20 | 2.69 | 80.98 | 97.55 | 39.00 |
| Permeate Run 2 | 1.18 | 11.20 | 2.69 | 80.98 | 97.55 | 39.00 |
| Permeate Run 3 | 1.53 | 10.50 | 3.54 | 75.36 | 97.70 | 19.73 |
| Permeate Run 4 | 1.53 | 10.50 | 3.54 | 75.36 | 97.70 | 19.73 |
| Permeate Run 5 | 2.41 | — | 4.18 | 61.12 | — | 5.22 |
| Retentate | 13.12 | 1070 | 5.72 | −111.83 | −134.14 | −29.71 |

Example 6

Retentate Conversion by Dealkylation Refining

The general procedure described in Example 2 was followed. A 300 cc autoclave was charged with 100 g of the retentate from Example 5, along with a catalyst containing 500 ppm of molybdenum, prepared by the procedure of Example 1. The final hydrogen pressure was chosen to be 500 psig/3500 kPag, the temperature was 425° C. and the time of reaction was 90 minutes. After the reaction, 23.4 g of liquids were collected from the knock-out vessel; these are all 650° F.−/345° C.−. Gas make was 4.1 wt %. The liquids remaining in the autoclave (72.5 g) were subjected to a simulated distillation which showed that it contained 23% of 650° F.$^-$/345° C.−, 52% 650-1050° F./345-565° C., and the remainder, 25% was 1050° F.$^+$/565° C.+. On a whole crude basis the overall process would yield approximately 10% of 650° F.$^-$/345° C.−, 79% of 650-1050°/345-565° C., and 11% 1050° F./565° C.+.

The invention claimed is:

1. A process for the conversion of a residual petroleum feed which comprises:

subjecting a residual petroleum feed having an initial boiling point of at least 650° F./345° C. to membrane separation to produce a permeate and a retentate, the permate being lower in metals and Microcarbon Residue (MCR) relative to the retentate, subjecting the retentate to hydroconversion at elevated temperature in the presence of hydrogen at a hydrogen pressure not higher than 500 psig (3500 kPag) in the presence of a dispersed metal-on-carbon catalyst to produce a hydroconverted effluent and fractionating the hydroconverted effluent.

2. A process according to claim 1 in which the residual petroleum feed has a Microcarbon Residue of >3 wt %.

3. A process according to claim 1 in which the hydroconversion step is carried out at a hydrogen pressure of not more than 250 psig (1725 kPag).

4. A process according to claim 1 in which the hydroconversion step is carried out at a temperature of 770° F./410° C. to 850° F./450° C.

5. A process according to claim 1 in which the amount of catalyst in the hydroconversion is from 100-2000 ppmw calculated as metal, relative to feed.

6. A process according to claim 1 in which the higher boiling fraction is separated in the membrane separation step using a membrane having a permeability of 1,000 to 10,000 Gurley seconds.

7. A process according to claim 1 in which the permeate separated in the membrane separation step is subjected to a fluid catalytic cracking step.

8. A process according to claim 1 in which the metal-on-carbon catalyst comprises from 20 to 30 weight percent molybdenum.

9. A process according to claim 1 in which the hydroconverted effluent is fractionated to form low boiling fractions boiling no higher than 650° F./345° C. and relatively higher boiling fractions which boil no lower than 650° F./345° C.

10. A process according to claim 8 in which the lower boiling fractions from the hydroconversion step comprise 75 to 85 percent saturates and 15 to 25 percent aromatics.

11. A process according to claim 8 in which the higher boiling fractions comprise a gas oil fraction boiling no lower than 650° F./345° C. and a bottoms fraction boiling above the gas oil fraction.

12. A process according to claim 11 in which the gas oil fraction is subjected to a fluid catalytic cracking or a thermal cracking step.

13. A process according to claim 11 in which the bottoms fraction is subjected to a thermal cracking step.

14. A process according to claim 1 in which the permeate of the membrane separation step has a MCR (ASTM D4530) of not more than 8 weight percent.

15. A process according to claim 1 in which the retentate of the membrane separation step has a MCR (ASTM D4530) of at least 9 weight percent.

16. A process according to claim 1 in which the dispersed metal catalyst comprises a dispersed metal sulfide catalyst produced by the conversion of an oil-soluble compound of a metal of Groups 4 through 10 in the IUPAC Periodic Table (2004) in the presence of a hydrogen-containing gas at elevated temperature.

17. A process according to claim 16 in which the metal of the dispersed metal-on-carbon catalyst comprises a metal of Groups 5, 6 or 8 through 10 in the IUPAC Periodic Table (2004).

18. A process according to claim 17 in which the metal of the dispersed metal-on-carbon catalyst comprises molybdenum.

19. A process according to claim 16 in which the dispersed catalyst is produced by the conversion of an oil-soluble compound of a metal of Groups 4 through 10 in the IUPAC Periodic Table (2004) in the presence of a hydrogen and hydrogen sulfide.

20. A process according to claim 17 in which the hydroconversion step is carried out at a hydrogen pressure of not more than 250 psig (1725 kPag) and a temperature of 770° F./410° C. to 850° F./450 C.

21. A process according to claim 17 in which the amount of dispersed metal-on-carbon catalyst in the hydroconversion is from 100-2000 ppmw, calculated as metal, relative to feed.

22. A process according to claim 16 in which the retentate is separated in the membrane separation step using a membrane having a permeability of 1,000 to 10,000 Gurley seconds.

* * * * *